United States Patent [19]

Degenhardt et al.

[11] 4,068,249

[45] Jan. 10, 1978

[54] DEVELOPING APPARATUS

[75] Inventors: Karl-Heinz Degenhardt, Bad Schwalbach; Hermann Frank, Sulzbach; Gerhard Marx, Hahn, all of Germany

[73] Assignee: Hoechst Aktiengesellschaft, Germany

[21] Appl. No.: 442,868

[22] Filed: Feb. 15, 1974

[30] Foreign Application Priority Data

Feb. 19, 1973 Germany ..... 2308129

[51] Int. Cl.[2] ..... G03D 7/00

[52] U.S. Cl. ..... 354/300; 34/155

[58] Field of Search ..... 354/297, 300, 319, 324, 354/331; 34/36, 145, 155

[56] References Cited

U.S. PATENT DOCUMENTS

| | | | |
|---|---|---|---|
| 2,524,818 | 10/1950 | McHugh | 354/300 |
| 2,737,100 | 3/1956 | Horn | 354/300 |
| 3,229,608 | 1/1966 | Staub et al. | 354/300 X |
| 3,440,944 | 4/1969 | Endermann et al. | 354/300 X |

*Primary Examiner*—Fred L. Braun

*Attorney, Agent, or Firm*—James E. Bryan

[57] ABSTRACT

An apparatus for developing photosensitive material with a gaseous medium comprising a housing having a developing chamber therein, at least one rotor in said developing chamber, said rotor extending over substantially the entire width of material to be developed and being mounted at a distance of about 0.05 to 20 mm from the material to be developed, a device for introducing gaseous developer medium between the rotor and the interior walls of said chamber, and a device for passing material to be developed through the apparatus, whereby it contacts said gaseous developer medium.

26 Claims, 5 Drawing Figures

DEVELOPING APPARATUS

Figure 1:
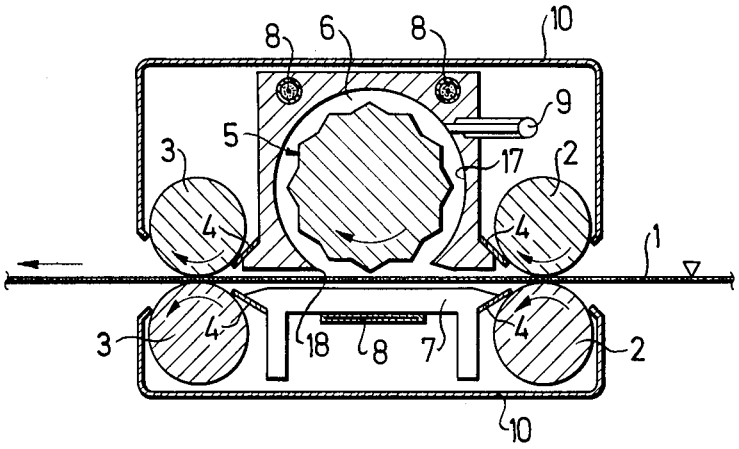

The invention relates to an apparatus for developing photosensitive material by means of a gaseous medium, especially a mixture of ammonia gas and water vapor. The vaporizer for producing the gaseous medium may be mounted within or outside of the apparatus. The apparatus can be used, for example, for developing materials having diazo coatings such as microfilms or blueprints. The developing apparatus is designed in particular as part of a blueprinter.

In known developing apparatuses, the developing gas is applied to the material to be developed with the aid of a fan which is fitted at a suitable locus in the developing apparatus. Austrian Pat. No. 257,359, for example, discloses a developing apparatus in which the developing gas is caused to circulate by means of a fan. In German Pat. No. 1,597,682, as laid open, there is described a developing apparatus in which a blower moves the developing gas along the path of travel of the material to be developed, in such manner that the material floats in the gas. It is known that the developing speed depends inter alia upon the temperature at which development is carried out and upon the optimum concentration of the developing medium. In this connection, it is important that the optimum concentration of developing medium be present at the surface of the material to be developed.

In all of the above-mentioned apparatuses, and despite the fact that the developing gas is caused to flow by means of fans, there is formed on the material to be developed a more or less deep layer, which is either stationary or involved in laminar flow and in which the concentration of developing gas diminishes in the direction of the material to be developed. Within this boundary layer, the developing gas moves onto the surface of the material to be developed by diffusion, i.e. the developing gas used while the material is being developed is replaced by diffusion only within this boundary layer. However, diffusion proceeds too slowly to counteract the drop in concentration of developing medium sufficiently rapidly, with the result that the developing speed is low.

German Pat. No. 1,572,289, as laid open, discloses a method of developing blueprint material in which the material is passed through zones of differing pressure. The material is passed between a belt and a porous cylinder in the interior of which is a rapidly rotating element comprising rotary slides.

The object of the present invention is to provide an apparatus in which, for the purpose of increasing the developing speed, the stationary or laminar boundary layer, in which the developing gas moves only by diffusion onto the material to be developed, is kept as thin as possible by producing high-speed turbulent streams of developing gas that move along the surface of the material to be developed.

According to the invention, an apparatus for developing photosensitive material by means of a gaseous medium has a vaporizer, within or outside of the apparatus, for producing the gaseous medium and includes at least one rotor extending over the entire width of the material to be developed, or by a plurality of shorter rotors which together cover the entire width of the material to be developed, the rotor or rotors being mounted directly above and/or below, and at a distance of 0.05 to 20 mm from, the material to be developed that is passed through the apparatus.

In the apparatus of the invention, the turbulent streams of developer gas, which pass through the non-turbulent boundary layer at the surface of the material to be developed and thus considerably reduce the non-turbulent boundary layer, are produced on the rapidly moving surface of the rotor. As already mentioned above, reduction of the non-turbulent boundary layer in which the developing gas moves onto the surface of the material to be developed, by diffusion only, results in the increase of the developing speed.

Since, in the method disclosed in German Pat. No. 1,572,289, as laid open, a perforated cylinder is mounted between the material and the rotor, a turbulent stream of developing gas that passes through a non-turbulent boundary layer is not created at the surface of the material to be developed. Because of the rotor being mounted directly above and/or below the material to be developed, the apparatus of the invention maintains the stationary or laminar boundary layer as thin as possible, and a high developing speed is thus achieved.

The rotor extends over the entire width of the material to be developed. In the case of wide developing apparatuses and for the purpose of achieving mechanical stability, it is preferred to use a plurality of shorter rotors which overlap one another so that they cover the entire width of the path along which the material travels.

The selected peripheral speed of the rotor will depend substantially upon the particular shape of the surface thereof and upon the speed at which the material to be developed passes through the apparatus. The peripheral speed of the rotor preferably should be at least twice as great as the speed at which the material to be developed is passed through the apparatus if a point on the surface of the rotor and on that side presented to the material to be developed moves in the same direction as that material. If a point on the surface of the rotor and on that side presented to the material to be developed moves in the direction opposite to that in which that material moves, the peripheral speed of the rotor preferably should be at least as great as the speed at which the material to be developed passes through the apparatus. When rolls having a smooth or roughened surface are used as the rotors, the peripheral speeds selected preferably are considerably greater than the above-stated values, whereas when use is made of rotors having a profiled surface or of rotors which are constituted by hollow rolls, perforated in the manner of a sieve, or by hollow rolls made of a porous material (e.g. sintered metal or a ceramic substance) from the interior of which the developing gas issues, the peripheral speeds selected are preferably in the neighborhood of the above-stated values.

The distance of the rotor from the material to be developed is between 0.05 and 20 mm, and preferably between 0.5 and 2 mm. As will be explained hereinafter, the optimum distance is also dependent upon the form of the rotor. Generally it can be said that rotors having a profiled surface or those constituted by hollow rolls are particularly suitable for producing turbulent streams. In the case of rotors having a profiled surface, the above-stated values for distance relate to the space between the material to be developed and the highest surface projections on the rotor.

Figure 3:
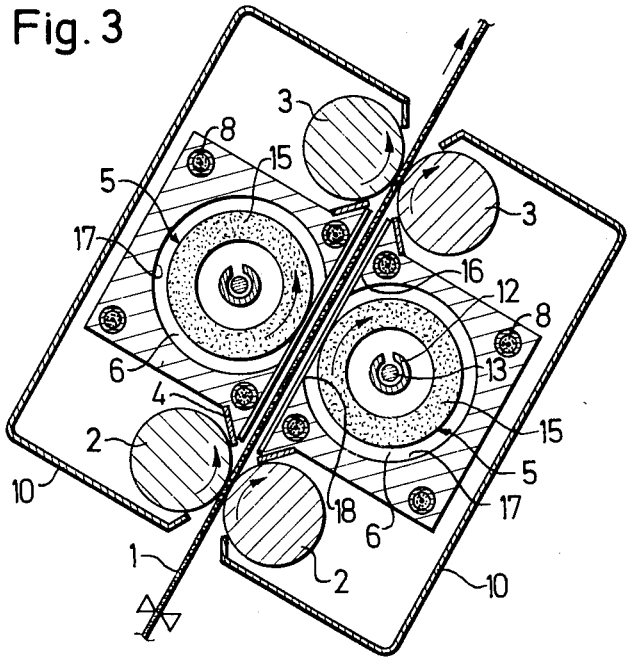
Figure 4:
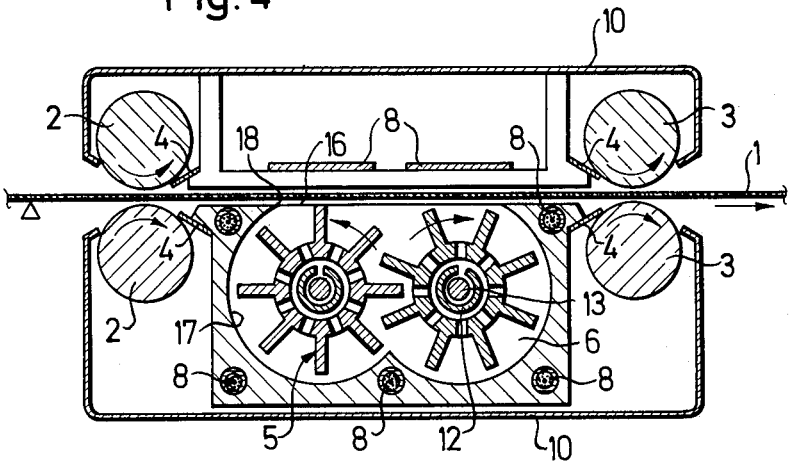
Figure 5:
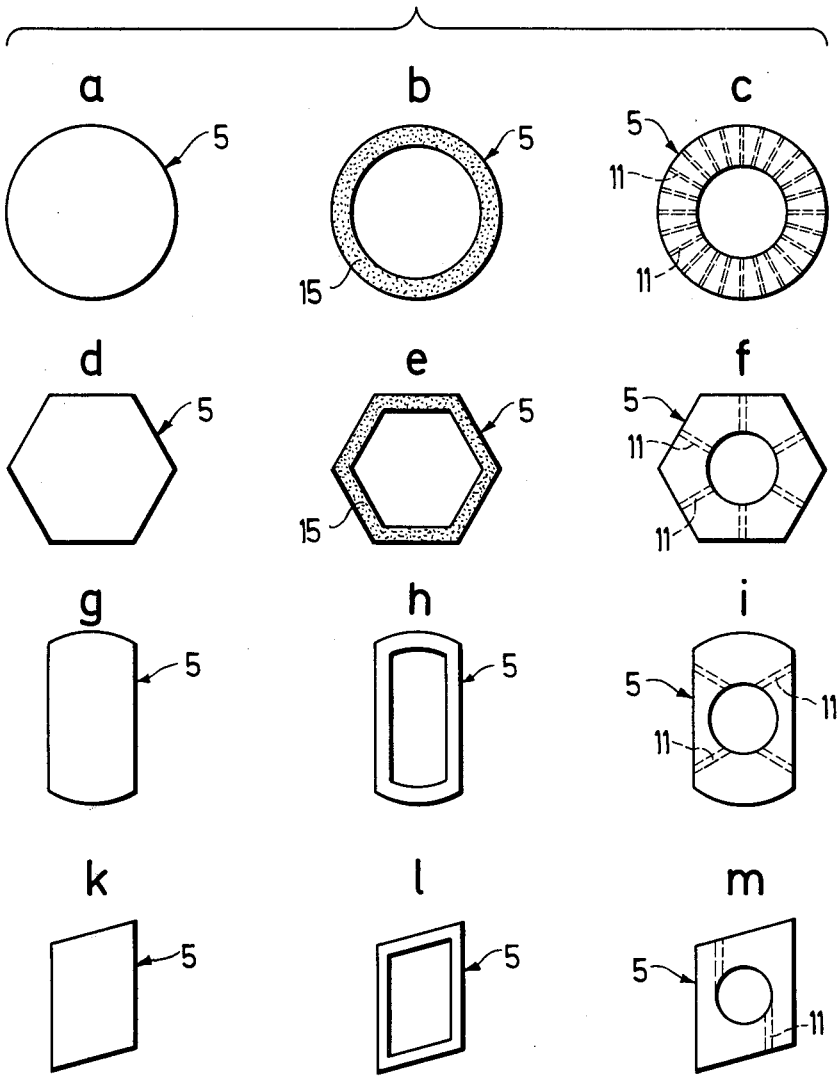

The invention will now be described in greater detail by reference to the accompanying drawings, in which:

FIGS. 1 to 4 show longitudinal sections, in the direction in which the material travels through the apparatus, through various forms of construction of the apparatus of the invention, and FIG. 5 shows cross-sections through various rotors that can be used in the apparatus of the invention.

The exposed material 1 to be developed, is passed through the apparatus, with its exposed side upwards, with the aid of the pair of feed and discharge rolls 2 and 3. The apparatus is sealed off from the surroundings by means of sealing strips 4 provided on the feed and discharge rolls 2 and 3. The rotor 5 seen in FIG. 1 is in the form of a roll having a knurled surface, this roll largely filling the developing chamber 6. The material 1 to be developed runs between the rotor 5 and the guide plate 7. Heating means 8 are provided on the guide plate 7 and in the upper wall of the developing chamber 6. A pipe 9 for supplying the developing gas is provided in the upper part of the developing chamber. The developing chamber 6, the roll pairs 2 and 3 and the guide plate 7 are enclosed by the housing 10.

Figure 2:
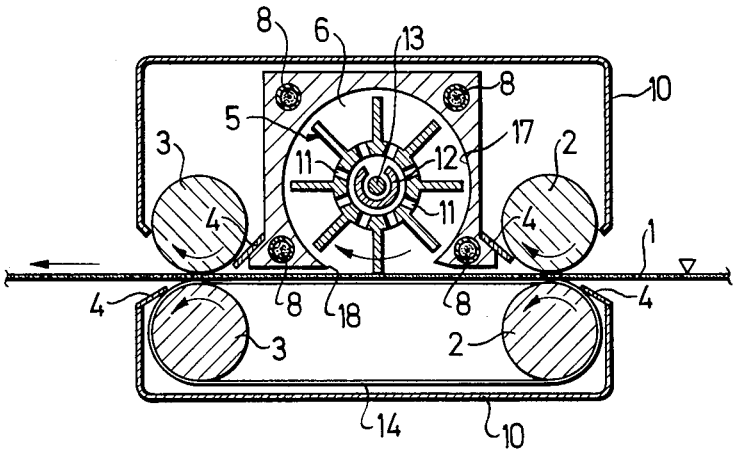

The rotor 5 shown in FIG. 2 is of star-shaped cross-section and is hollow. It has port 11 through which can issue the developing gas produced in the interior thereof. Fitted within the rotor is a vaporizer 12 with a heating means 13 for producing the developing gas. The material 1 to be developed is moved past the rotor 5 on the conveyor belt 14. In this arrangement too, the rotor 5 occupies most of the developing chamber 6.

FIG. 3 illustrates a form of construction in which a rotor 5 is provided both above and below the path over which the material 1 travels. The rotors 5 are in the form of hollow rolls having walls 15 which are made of a porous material through which the developing gas, produced within the rolls, can issue. Between the rotors 5 and the material to be developed there are fitted tensioned wires 16 which guide the material but which are mounted at large distances from each other in order not to inhibit the development of turbulent flow on the surface of the material.

FIG. 4 illustrates a form of construction comprising two juxtaposed rotors of star-shaped cross-section. The material to be developed is here passed through the apparatus with its exposed surface facing downwards. In all four arrangements, the side walls 17 which delimit the developing chamber 6 are curved inwardly towards the center of the chamber 6 at their lower ends. The edges 18 thus formed are particularly effective in the creation of turbulent streams of gas.

FIG. 5 shows further possible cross-sectional forms for the rotor. FIG. 5*a* shows a roll having a smooth surface, FIG. 5*b* a hollow roll of porous material 15, FIG. 5*c* a hollow roll with sieve-like perforations 11, FIG. 5*d* a rotor of hexagonal cross-section, FIG. 5*e* a hollow rotor of hexagonal cross-section and having a porous wall, and FIG. 5*f* a hollow rotor, in the wall of which apertures are formed. FIGS. 5*g* to 5*i* show various forms of rotor which are based on a roller having two flattened faces; finally, FIGS. 5*k* to 5*m* illustrate rotors of rectangular cross-section. In the case of the hollow rotors having walls made of porous material or walls with apertures therein, the developing gas can be introduced into the interior of the rotor or can be produced within it if a vaporizer is provided in the interior thereof. The forms of rotor illustrated in FIG. 5 do not represent all the possibilities, and the invention is not limited thereby. Other forms of rotor are possible, e.g. rotors of helical shape.

If rolls having smooth surfaces are used as the rotors (FIG. 5*a*), then the optimum distance between the rotor and the material to be developed is 0.5 mm; if the surface is roughened, then the optimum for this distance is 0.8 mm. If rotors having a profiled surface (FIGS. 1 and 5*d*) are used, the optimum distance is 1 mm. In the case of all rotors where the developing gas issues from the interior through a porous wall or apertures (FIGS. 2 to 4, 5*b*, 5*c*, 5*e*, 5*f*, 5*h*, 5*i*, 5*l* and 5*m*), the optimum distance is between 1 and 2 mm.

It will be obvious to those skilled in the art that many modifications may be made within the scope of the present invention without departing from the spirit thereof, and the invention includes all such modifications.

What is claimed is:

1. An apparatus for developing photo-sensitive material with a gaseous medium comprising housing means having developing chamber means therein, at least one rotor means in said developing chamber means, said rotor means extending over substantially the entire width of material to be developed and being mounted at a distance of about 0.05 to 20 mm from the material to be developed, the peripheral speed of the rotor means being at least twice as great as the speed at which the material to be developed passes through the apparatus when a point on the surface of the rotor and on that face presented to the material to be developed moves in the same direction as the material, means for introducing gaseous developer medium between said rotor means and the interior walls of said chamber means, and means for passing material to be developed through said apparatus, whereby it contacts said gaseous developer medium.

2. An apparatus according to claim 1 in which said rotor means includes a plurality of rotors.

3. An apparatus according to claim 1 in which the distance between the rotor means and the material to be developed is between about 0.5 and 2 mm.

4. An apparatus according to claim 1 in which the rotor means is a roll having a polished surface.

5. An apparatus according to claim 1 in which the rotor means is a roll of hexagonal cross-section.

6. An apparatus according to claim 1 in which the rotor means is a hollow roll of porous material.

7. An apparatus according to claim 1 in which the rotor means is a hollow perforated roll.

8. An apparatus according to claim 1 including vaporizer means in said rotor means.

9. An apparatus according to claim 1 in which said developing chamber means is substantially filled by said rotor means.

10. An apparatus according to claim 1 in which the rotor means is a roll having a sand-blasted surface.

11. An apparatus according to claim 1 in which the rotor means is a roll having a grooved surface.

12. An apparatus according to claim 1 in which the rotor means is a roll having a knurled surface.

13. An apparatus according to claim 1 in which the rotor means is a roll having a star-shaped cross-section.

14. An apparatus for developing photo-sensitive material with a gaseous medium comprising housing means having developing chamber means therein, at least one rotor means in said developing chamber means, said rotor means extending over substantially the entire width of material to be developed and being mounted at a distance of about 0.05 to 20 mm from the material to be developed, the peripheral speed of the rotor means being at least as great as the speed at which the material to be developed passes through the apparatus when a point on the surface of the rotor and on that side presented to the material to be developed moves in the opposite direction to that of the material, means for introducing gaseous developer medium between said rotor means and the interior walls of said chamber means, and means for passing material to be developed through said apparatus, whereby it contacts said gaseous developer medium.

15. An apparatus according to claim 14 in which said rotor means includes a plurality of rotors.

16. An apparatus according to claim 14 in which the distance between the rotor means and the material to be developed is between about 0.5 and 2 mm.

17. An apparatus according to claim 14 in which the rotor means is a roll having a polished surface.

18. An apparatus according to claim 14 in which the rotor means is a roll having a sand-blasted surface.

19. An apparatus according to claim 14 in which the rotor means is a roll having a grooved surface.

20. An apparatus according to claim 14 in which the rotor means is a roll having a knurled surface.

21. An apparatus according to claim 14 in which the rotor means is a roll of hexagonal cross-section.

22. An apparatus according to claim 14 in which the rotor means is a roll of star-shaped cross-section.

23. An apparatus according to claim 14 in which the rotor means is a hollow roll of porous material.

24. An apparatus according to claim 14 in which the rotor means is a hollow perforated roll.

25. An apparatus according to claim 14 including vaporizer means in said rotor means.

26. An apparatus according to claim 14 in which said developing chamber means is substantially filled by said rotor means.

* * * * *